United States Patent [19]

Kozai et al.

[11] 4,320,187

[45] Mar. 16, 1982

[54] PHOTOGRAPHIC FILM UNIT FOR DIFFUSION TRANSFER WITH A TRANSLUCENT MASK SHEET

[75] Inventors: Katsuya Kozai, Minami-ashigara; Teruyoshi Makino, Isehara; Hisashi Kikuchi, Minami-ashigara, all of Japan

[73] Assignee: Fuji Photo Film Co., Ltd., Kanagawa, Japan

[21] Appl. No.: 191,781

[22] Filed: Sep. 29, 1980

[30] Foreign Application Priority Data

Sep. 27, 1979 [JP] Japan ..... 54/124934

[51] Int. Cl.[3] ..... G03C 1/48; G03C 5/54

[52] U.S. Cl. ..... 430/207; 430/499

[58] Field of Search ..... 430/207, 499, 496

[56] References Cited

U.S. PATENT DOCUMENTS 4,264,718 4/1981 Luhrig et al. ..... 430/207

4,273,852 6/1981 Lange ..... 430/207

*Primary Examiner*—Richard L. Schilling

*Assistant Examiner*—John L. Goodrow

*Attorney, Agent, or Firm*—Sughrue, Mion, Zinn, Macpeak and Seas

[57] ABSTRACT

In a film unit for photography of the diffusive transfer process type including a photosensitive laminate, a mask sheet defining an image border definition with an aperture provided therein, a pod for a processing liquid etc. with, the mask sheet being made of a translucent material.

2 Claims, 6 Drawing Figures

PHOTOGRAPHIC FILM UNIT FOR DIFFUSION TRANSFER WITH A TRANSLUCENT MASK SHEET

FIELD OF THE INVENTION

This invention relates to a film unit, which is used for the photography of the multicolor diffusive transfer process type, and more particularly, to several improvements concerning an image border definition.

BACKGROUND OF THE INVENTION

Conventionally, in film units for use in the photography of the multi-color diffusive transfer process type (hereinafter referred to as a film unit), there have already been proposed various types, and the typical type thereof is shown in FIGS. 1 to 5 of the accompanying drawings, which has already been disclosed in Japanese Laid Open Patent Publication (Tokkaisho) No. 50-153628. FIG. 1 is a top plan view of the film unit, while FIG. 5 is an exploded view showing the disassembled state of the components, in which the pod and trap ends have not been folded over yet. As can be seen from these FIGS. 1 and 5, the film unit comprising a plurality of laminated layers each contributing to a self-processing photographic function, including a first sheet 1, a second sheet 2, a mask sheet 3 defining an image border definition with an aperture provided therein, a rupturable container or pod (member) 4 containing an aqueous processing liquid, a trap (member) 5 capable of retaining therein the surplus processing liquid after the diffusion transferring process and a pair of spacers 6 for use in regulating the thickness of the processing liquid to be spread over a layer constituting the first sheet 1. More specifically, in the film unit of such self-processing photographic function, the first sheet 1 comprising layers each having the same dimensions and composed of processing material for its full dimensions is applied thereon, the following in sequence, i.e. the mask 3 having the rectangular aperture defining the image area, the respective pod 4 and trap member 3 on both transverse aperture-bordering planes 3*d*, 3*c* of the mask, the paired spacers 6, 6 on both sides of lateral aperture bordering planes 3*a*, 3*b* of the mask and the transparent cover sheet 2. Accordingly, the mask 3, the paired spacers 6, 6, respective pod 4 and the trap member 5 are sandwiched between the first sheet 1 and the cover sheet 2, in which the pod and trap ends of the mask 3 are both folded over in a manner such that these can form respectively the pod and trap with respective subsidiary members. Consequent construction of the film unit is adapted to cause the pod's content to be effectively spread over the first sheet 1 when subjected to pressure, with a result that the self-processing photographic functioning is thus effected. As will be easily understood from the description hereinbelow, the film unit having such construction tends to have the consequent deterioration in image quality on the periphery 12 (see FIG. 2) of the image border definition, i.e. the occurrence of dotted dirt 13 (see FIG. 4) caused by uneven concentration, after the completion of the self-processing functioning thereof under a pressure loading condition. Namely, when the mask 3 is applied upon the first sheet 1, a heat-sensitive bonding agent is conventionally used. Such being the case, it is very difficult to completely seal the entire faces being bonded to each other, and some portions 14 (see FIG. 3) therebetween remain unsealed. Due to such undesirable sealing state, the processing liquid 7 permeates through unsealed portions 14, FIG. 6, with the result of such occurrence of dotted dirts 13 as described above.

More specifically, according to conventional film units (e.g. that disclosed in Japanese Laid Open Patent Publication (Tokkaisho) No. 50-153628), the mask 3 superposed on the first sheet 1 is made of opaque material, so that the photosensitive laminate of the first sheet 1 is prevented from being exposed except for the portion inside the image border definition, which is defined by the aperture provided in the mask. Furthermore, in the thermal bonding operation between the first sheet 1 and the mask 3, the sealing operation can not be carried out at a high temperature under a high pressure condition, since such operational condition results in a bad influence on the photosensitive laminate, consequently resulting in the occurrence of such unsealed portions 14 as shown in FIG. 3. As far as such unsealed portions 14 are concerned, when these portions are full of the processing liquid, through the permeation thereof, these portions are developed to a maximum concentration level within the photosensitive laminate, with these portions being shielded from a radiation light and developed in the absence of the light exposure. Such non-exposed portions consequently appear as dots 13 of uneven concentration on the periphery of the image border definition. The occurrence of such deterioration in image quality is especially undesirable in the case where the consequent, photographic image is to have white or almost white image borders.

Accordingly, an essential object of the present invention is to provide a photographic film unit, which does not involve any consequent deterioration in image quality especially on the periphery of the image border.

Another important object of the present invention is to provide a photographic film unit of the above described type, which is adapted to have a construction capable of preventing the occurrence of dot-like dirt caused by the uneven processing liquid concentration on the periphery of the image border definition.

A further object of the present invention is to provide a photographic film unit of the above described type, which is simple in construction and, which is highly efficient in use.

SUMMARY OF THE INVENTION

In accomplishing these and other objects according to one preferred embodiment of the present invention, there is provided a film unit for photography of the diffusive transfer process type as will be described hereinbelow. The film unit comprises a first sheet of a photosensitive laminate applied thereon by a mask sheet defining an image border definition, with an aperture therein, a second sheet superposed on the first sheet in face to face relationship with the first sheet and a rupturable container sandwiched between respective end-portions of the first sheet and the second sheet in a manner such that a processing liquid contained in the container can be released in the spacing between the first sheet and the second sheet when subjected to pressure. At least a portion constituting a bordering portion of the aperture is made of a translucent material. By the arrangement of the invention, in accordance with the light exposure of unsealed portions between the mask sheet and the first sheet, the portions of the first sheet underlying these unsealed portions execute the self-processing function in an ordinary manner, subject to the condition that the unsealed portions are filled with the processing liquid through the permeation thereof. Accordingly, since there is no possibility that only the development of the unsealed portions is especially exceeded, so as to be accompanied by the generation of portions each having quite a high concentration, the occurrence of dot-like dirt caused by uneven concentration on the periphery of the image border definition is prevented.

These and other objects and features of the present invention will become apparent from the following description taken in conjunction with the preferred embodiment thereof with reference to the accompanying drawings.

BRIEF DESCRIPTION OF THE DRAWINGS

Before the description of the present invention proceeds, it is to be noted that like parts are designated by like reference numerals throughout several views of the accompanying drawings.

DESCRIPTION OF THE PRIOR ART AND THE PRESENT INVENTION

Figure 1:
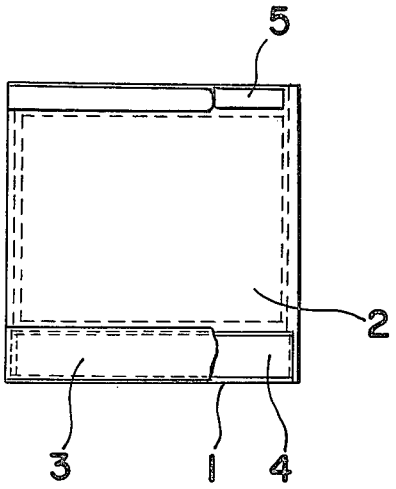
Fig. 1 (PRIOR ART)
FIG. 1 is a partially exploded top plan view of a film unit of the typical type.
Figure 2:
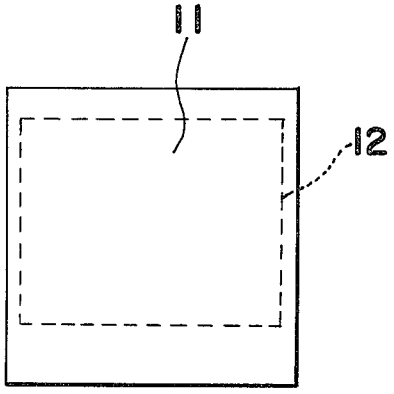
Fig. 2 (PRIOR ART)
FIG. 2 is a view similar to FIG. 1, particularly illustrating an image border definition.
Figure 3:
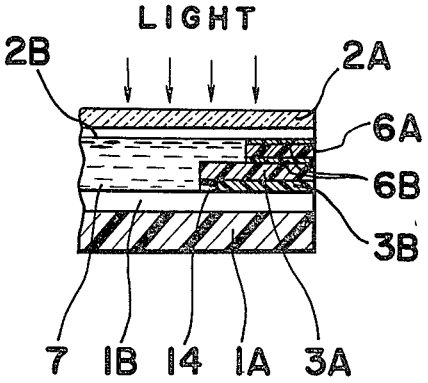
Fig. 3 (PRIOR ART)
FIG. 3 is a cross sectional view part of a film unit of conventional construction, particularly exemplifying a deficiency inherent in the conventional film unit.
Figure 4:
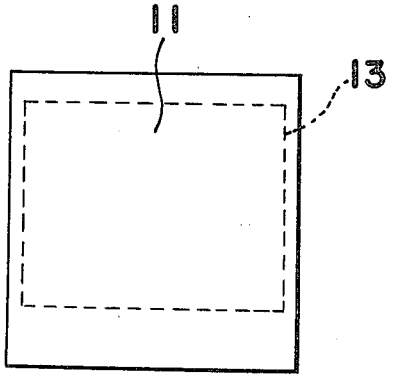
Fig. 4 (PRIOR ART)
FIG. 4 is a view similar to FIG. 2, particularly illustrating dirt-like dots caused by uneven processing liquid concentration.
Figure 5:
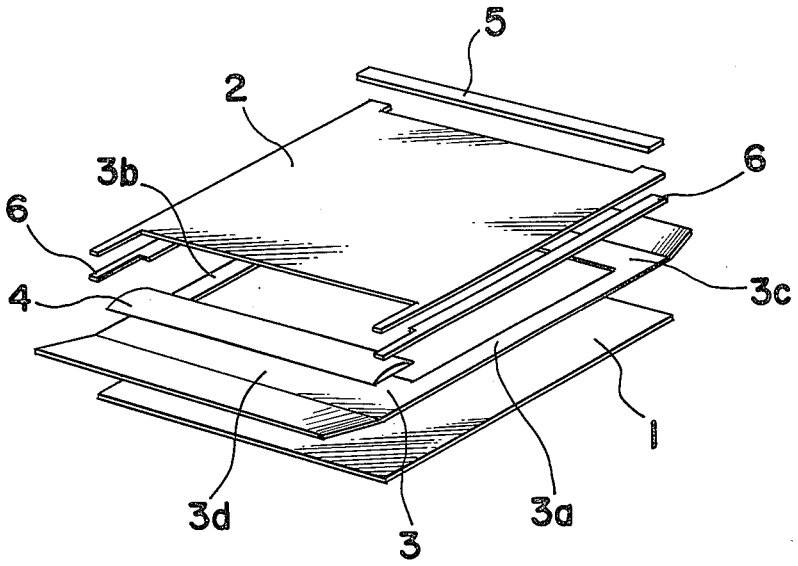
Fig. 5 (PRIOR ART)
FIG. 5 is an exploded view showing the disassembled relationship of the components of the film unit shown in FIG. 1.

Referring first to FIG. 3, there is shown a partial, cross sectional view of a film unit in accordance with one conventional embodiment thereof with the various components constituting the construction of the film unit being greatly enlarged for purposes of illustration only. As can be seen from FIG. 3, the film unit includes a first sheet 1 of a photosensitive laminate comprising a plurality of layers each contributing to a self-processing photographic function, which has applied thereon by the following in sequence, i.e. a mask 3 defining an image border definition with an aperture therein, spacers 6 for use in regulating the thickness of the liquid layer to be discharged over the photosensitive sheet 1 and a cover sheet or a second sheet 2. More specifically, the first sheet 1 includes an opaque support 1A and a photosensitive layers portion 1B, while the second sheet 2 includes a transparent support 2A and a neutralizer layer 2B. The spacer 6 comprises a support body 6A and bonding agent layers 6B, 6B on both sides of the support body 6A, while the mask (sheet) 3 comprises a sheet body 3A and a bonding agent layer 3B on the side of the photosensitive layers portions 1B.

Figure 6:
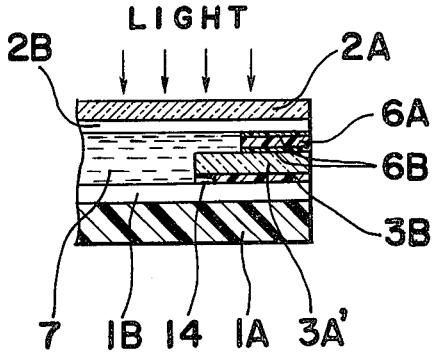
FIG. 6 is a sectional view similar to FIG. 3, particularly showing a film unit in accordance with one preferred embodiment of the present invention.

In accordance with one preferred embodiment of the invention, FIG. 6, the construction and feature of the film unit is no different from such conventional film unit as shown in FIGS. 1, 2, 3 and 5, except that the mask sheet 3A' is made of a translucent material. Namely, according to the conventional film unit, the mask sheet is made of one selected from black, opaque materials, whereas the mask sheet 3A' of the invention is made of the translucent material. With the introduction of such mask sheet of the invention, the light can pass through the mask sheet 3A' and then, the portions underlying below the peripheral portions of the mask sheet 3A' are light-exposed, when the image-wise light exposure through the first sheet 1 is performed. Such being the case, even if the processing liquid 7 has permeated into the unsealed portions 14, which exist between the first sheet 1 and the mask sheet 3, there can be obtained a photographic image which has no dot-like dirt in and around the image border definition 12. Namely, since there can be no such possibility, only the development of the unsealed portions 14 proceeds in a rapid manner so as to be accompanied by the generation of portions each having quite a high concentration and the occurrence of the dot-like dirt of uneven concentration on the periphery of the image border definition can be prevented. Needless to say, such portions of the photosensitive sheet 1 completely superposed thereon by the mask sheet 3A' do not permit the permeation of the processing liquid 7. Therefore, even if such portions as stated above are subjected to the exposure, neither the development, nor the formation of the picture image can be performed and therefore, the image border definition can be substantially effected in a predetermined manner.

As may be clear from the description in the foregoing, the entire mask sheet 3A' is not necessarily made of a translucent material, only the peripheral portion of the aperture defining the image border definition 12 need be made of a translucent material. Accordingly, if one wants, for example, to some what improve the outer appearance of the film unit, the respective ends of the mask sheet 3A', which are folded over when the pod 4 and the trap member 5 are assembled, may be colored black so that the pod 4 and trap member 5 can not be seen directly at a glance. Furthermore, if the mask sheet 3A' is made of a transparent material, the difficulty concerning the introduction of the optical detection method in association with its manufacturing process can be eliminated by partially coloring it with a stripe or the like. Such being the case, if the stripe is located on the periphery of the image bordering aperture, there can be effected such dot-like dirt as described earlier on the corresponding portions of the consequent picture. However, this dot-like dirt can hardly be conspicuous, if the width of the stripe is reasonably narrow. To prevent the occurrence of an incident-light exposure or the light-piping from the outside edge portions of the translucent mask sheet 3A', the mask sheet 3A' is preferably applied by a hazing treatment or a proper coloring treatment.

As can be clear from the description in the foregoing, in a photographic film unit comprising the first sheet applied thereon by the mask sheet, the second sheet and the pod containing therein the processing liquid, the film unit of the invention is characterized in that at least peripheral portion of the image border aperture of the mask is made of a translucent material. By the arrangement of the invention, in accordance with the light exposure of the unsealed portions between the mask sheet and the first sheet, the portions of the first sheet underlying these unsealed portions execute the self-processing function in an ordinary manner, subject to the condition that the unsealed portion are filled with the processing liquid through the permeation thereof. Accordingly, since there can be no possibility that only the development of the unsealed portions is extremely exceeded, being accompanied by the generation of portions each having quite a high concentration, the occurrence of the dot-like dirt caused by uneven concentration on the periphery of the image border definition is prevented. Moreover, in the manufacturing process of the film unit, there is no need, in particular, to apply the mask sheet upon the first sheet at a high temperature under a high pressure condition. As a result, the film unit per se can be manufactured through a simple manufacturing procedure without causing any bad influence upon any curling operations included in the manufacturing process.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A film unit for photography of the diffusive transfer process type, said unit comprising a laminate including a first photosensitive sheet, a mask sheet defining an image border definition with an aperture therein, a second sheet superposed on said first sheet in a face to face relationship with said first sheet and wherein a rupturable container is sandwiched between respective end portions of said first sheet and said second sheet in a manner such that a processing liquid contained in said container can be released in a spacing between said first sheet and said second sheet when subjected to pressure, and wherein at least an aperture bordering portion of said mask sheet is made of a translucent material.

2. A film unit for photography of the diffusive transfer process type as claimed in claim 1, wherein said portion of said mask made of said translucent material has further applied thereto, a hazing treatment.

* * * * *